166-274 3R
12/16/86 OR 4,628,999

United States Patent [19]
Kiss et al.

[11] Patent Number: 4,628,999
[45] Date of Patent: Dec. 16, 1986

[54] PROCESS EMPLOYING $CO_2$/CH GAS MIXTURES FOR SECONDARY EXPLOITATION OF OIL RESERVOIRS

[76] Inventors: László Kiss, 10 Kun Bela u, Nagykanizsa; Sándor Dolleschall, 21/B. Városkuti ut, Budapest XII; Ede Németh, 4, Kovacs K. ter, Zalaeqerszeg; Janos Török, 1, Varsanyi I. u., Budapest II; György Tiszai, 25 Oswald J. u., Nagykanizsa; Valér Balint, 46/b. Szakasits Á u., Budapest 1115, all of Hungary

[21] Appl. No.: 692,840

[22] Filed: Jan. 18, 1985

Related U.S. Application Data

[63] Continuation-in-part of Ser. No. 563,881, Dec. 21, 1983, abandoned, which is a continuation of Ser. No. 1,373, Jan. 5, 1979, abandoned, which is a continuation-in-part of Ser. No. 880,171, Feb. 21, 1978, abandoned, which is a continuation of Ser. No. 776,968, Mar. 14, 1977, abandoned, which is a continuation of Ser. No. 602,795, Aug. 7, 1975, abandoned, which is a continuation-in-part of Ser. No. 368,887, Jun. 11, 1973, abandoned.

[51] Int. Cl.[4] ..... E21B 43/18; E21B 43/20; E21B 43/30

[52] U.S. Cl. ..... 166/274; 166/245; 166/268

[58] Field of Search ..... 166/245, 263, 268, 269, 166/273, 274, 305.1

[56] References Cited

U.S. PATENT DOCUMENTS

| | | | |
|---|---|---|---|
| 2,623,596 | 12/1952 | Whorton et al. | 166/274 |
| 2,842,204 | 7/1958 | Horner | 166/268 |
| 3,084,743 | 4/1963 | West et al. | 166/274 X |
| 3,193,006 | 7/1965 | Lewis | 166/269 X |
| 3,285,338 | 11/1966 | Boston | 166/273 X |
| 3,295,601 | 1/1967 | Santourian | 166/273 X |
| 3,393,735 | 7/1968 | Altamira et al. | 166/268 X |
| 3,500,914 | 3/1970 | Petteway | 166/268 |
| 3,620,304 | 11/1971 | Hearn et al. | 166/274 |
| 3,811,501 | 5/1974 | Burnett et al. | 166/274 X |
| 3,995,693 | 12/1976 | Cornelius | 166/268 |

FOREIGN PATENT DOCUMENTS

| | | | |
|---|---|---|---|
| 2235262 | 1/1975 | France | 166/274 |

*Primary Examiner*—George A. Suchfield
*Attorney, Agent, or Firm*—Michael N. Meller

[57] ABSTRACT

From 5 to 35%, preferably 10 to 30%, by volume of hydrocarbon gases may be incorporated as a diluent into carbon dioxide-containing gas injected during secondary exploitation of oil reservoirs. The reservoir pressure is maintained at 100 to 120 atm., respectively, up to 250 atm. The preferred range is 120 to 200 atm. The hydrocarbon gases may be added to the carbon dioxide-containing gas prior to injection and/or use may be made of ambient hydrocarbon gases present in the reservoir. The optimum gas injection rate is 40–80 $m^3$/day/m of formation.

7 Claims, 10 Drawing Figures

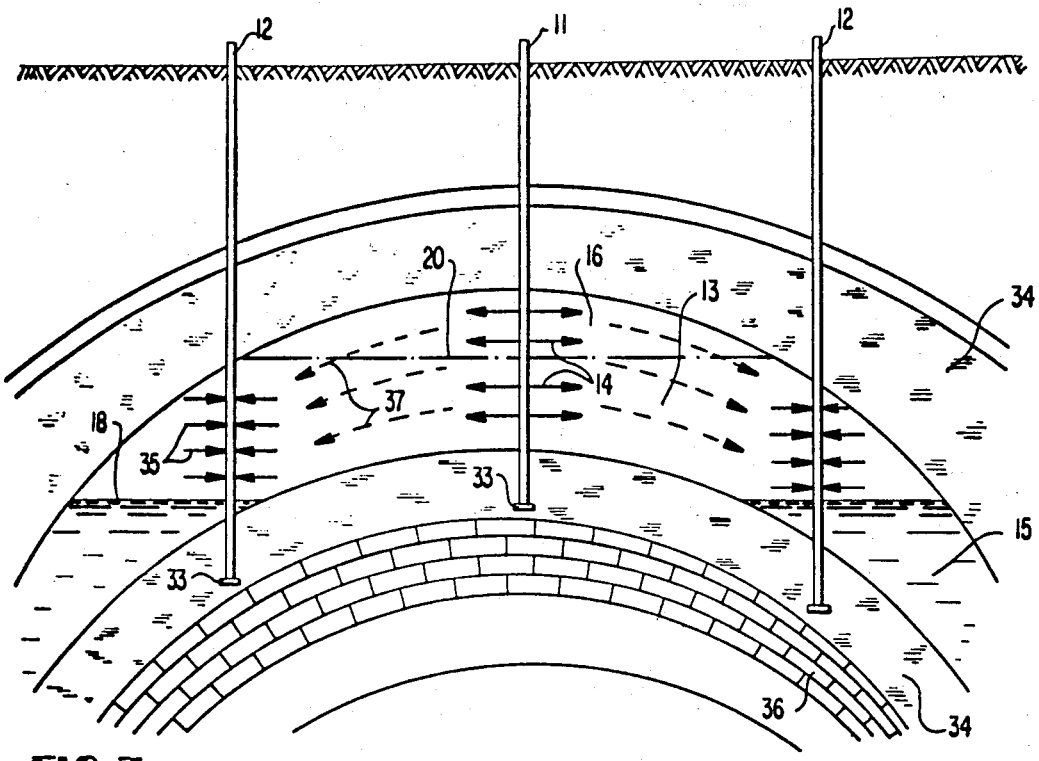
FIG. 3
FIG. 4
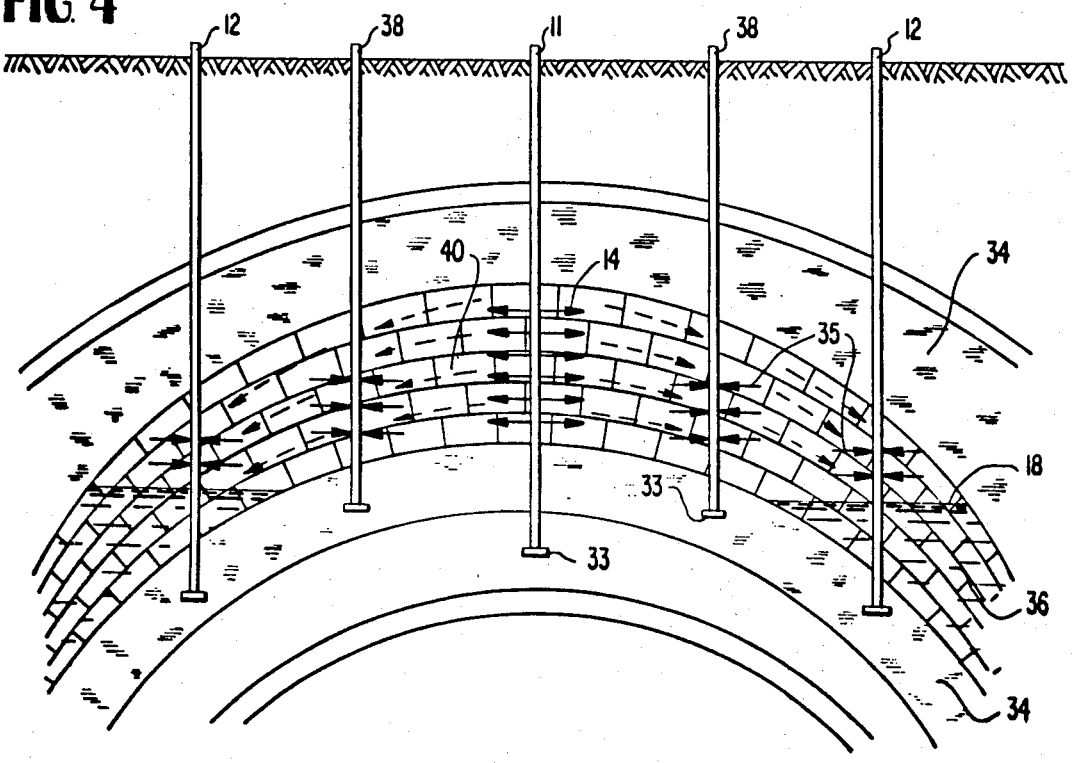

PROCESS EMPLOYING $CO_2$/CH GAS MIXTURES FOR SECONDARY EXPLOITATION OF OIL RESERVOIRS

CROSS REFERENCE TO RELATED APPLICATIONS

This application is a continuation-in-part application of Ser. No. 563,881, filed Dec. 21, 1983 which is a continuation application of Ser. No. 001,373, filed Jan. 5, 1979; which is a continuation-in-part application of Ser. No. 880,171, filed Feb. 21, 1978; which is a continuation application of Ser. No. 776,968, filed Mar. 14, 1977; which is a continuation application of Ser. No. 602,795, filed Aug. 7, 1975; which is a continuation-in-part application of Ser. No. 368,887, filed June 11, 1973, all now abandoned.

BACKGROUND OF THE INVENTION

In recent years and in many countries of the world increasing research and experimental work has been performed to find new, effective and economical displacing media in which the secondary exploitation of oil reservoirs may be performed and to increase the efficiency of recovery, the areal and volumetric sweep efficiency, and the recovery factor respectively.

A number of attempts have involved the use of carbon dioxide under pressure. Carbon dioxide, above a certain pressure level, is readily soluble in water, excellently soluble in oil and in the context of the present invention has the following effects:

1. Upon dissolution in the oil it increases the volume of the oil and thus leads to an increased relative oil saturation, to increased effectiveness of displacement of the oil and to increased recovery factor.

2. It decreases the viscosity of the oil, thereby increasing the effectiveness of the oil displacement and the efficiency of recovery, respectively.

3. It decreases the surface and interfacial tension, thereby increasing the effectiveness of displacement of the oil and the recovery factor, respectively.

4. It dissolves calcium carbonate binding material in sandstone and the rock material in limestone reservoirs, thus increasing primarily the permeability of the formation. Further it causes cross-flow and thus leads to increased surface and volumetric effectiveness of displacement and the recovery factor, respectively.

Whorton et al (U.S. Pat. No. 2,623,596) discloses the effect of the percentage of $CO_2$ in a gas injected during secondary exploitation of an oil reservoir and the injection pressure on the percentage of oil recovered. In a series of tests with $CO_2/N_2$ mixtures,it was determined that the minimum amount of $CO_2$ in the mixture should be 50% and the minimum injection pressure 1,000 psi; preferably followed by the injection of an inert fluid. The use of 100% of $CO_2$ is preferred but, if the availability of $CO_2$ is limited, it is disclosed that other gases such as nitrogen, air, natural gas or any other gas can be mixed in. Whorton et al do not indicate any preference for one gas over another.

The effect of $CO_2$ is in close correlation with the dissolution. Pure carbon dioxide is more soluble in oil, than the so-called mixed gas containing $CO_2$ and a CH (hydrocarbon) component as well.

Under reservoir conditions, however, it is rare that either the oil or the dissolving gas is free of hydrocarbon gases. Under such conditions, the oil always contains more or less hydrocarbon gas dissolved therein or dissolved in the free gaseous phase. Naturally occurring carbon dioxide gas is what is called a mixed natural gas, containing hydrocarbons. Even if hydrocarbons are removed from the mixed natural gas prior to utilization of the carbon dioxide for secondary recovery of oil reservoirs, there will again be an admixture of hydrocarbon gas with the carbon dioxide upon injection of the carbon dioxide into the reservoir due to the CH components present in the reservoir. The solubility of carbon dioxide in oil is decreased by the presence of these hydrocarbon gases.

In view of the negative effect of hydrocarbon gases on the solubility of $CO_2$ in oil, which is directly related to the oil recovery percentage, as shown below, it might be deduced that the use of $N_2$ mixed with $CO_2$ would be preferable to natural gas as a diluent, if a diluted $CO_2$ was desired for injection into the oil reservoirs for secondary exploitation. Therefore, it was surprising to discover that, on the contrary, hydrocarbon gases are superior to nitrogen as a diluent in such applications.

SUMMARY OF THE INVENTION

The invention is based on the discovery that hydrocarbon gases are much more preferable to nitrogen as diluents for $CO_2$ injected during secondary recovery of oil reservoirs. Larger amounts of CH gases at lower pressures can be employed to obtain oil recovery yields comparable to those obtained using nitrogen as a diluent.

Accordingly, the invention relates to the use of from 5 to 35%, preferably 10% to 30% hydrocarbon gases as a diluent for $CO_2$ injected into the reservoir while maintaining a reservoir pressure of at least 100–120 atm, respectively, up to 250 at n, preferably 120–200 atm. The hydrocarbon gases may be injected with the $CO_2$ or use may be made of the ambient hydrocarbon gases already present in the reservoir.

BRIEF DESCRIPTION OF THE DRAWINGS

The invention will be illustrated in connection with the accompanying drawings in which

FIG. 3 shows a crude oil reservoir having a gas cap;

FIG. 4 shows a limestone reservoir having a limited supply of water;

DETAILED DESCRIPTION

Figure 1:
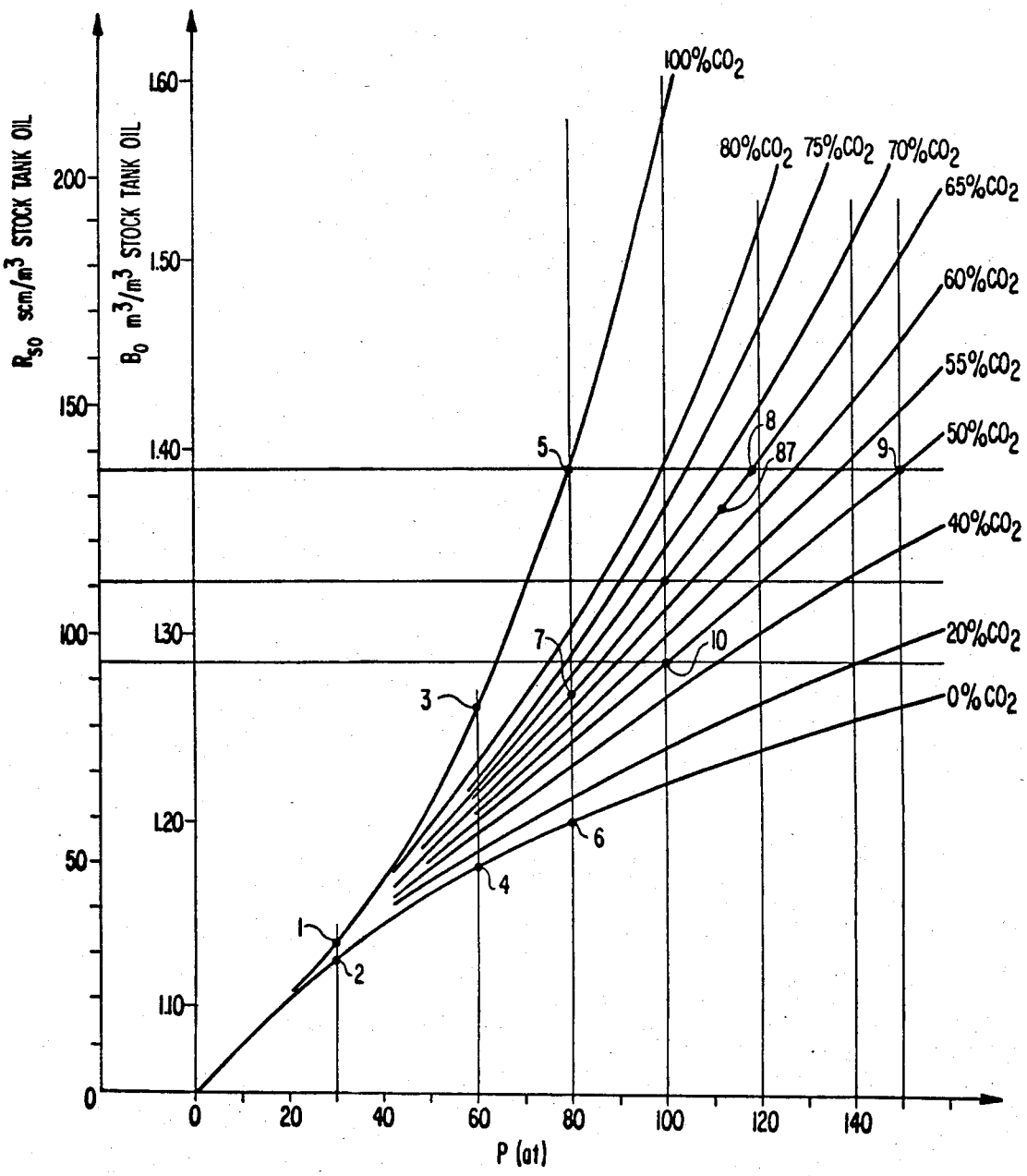
FIG. 1 shows the decreasing solubility of $CO_2$ in oil with increased amounts of hydrocarbon gases.

In FIG. 1, the solubility of the injected gas at a constant pressure is designated on the ordinate at $R_{so}$, in standard cubic meters per cubic meter of stock tank oil. The ratio $B_o$ of the volume of oil containing dissolved gas, compared to oil with no dissolved gas is also designated on the ordinate. Pressure in atmospheres is shown on the abscissa, while the constant composition lines show the percentage of carbon dioxide.

It should also be understood that the constant composition curves containing $CO_2$ of FIG. 1 refer not merely to the injected gas but rather to the composition of the gas after injection, that is, after mixing with the ambient hydrocarbon gases present in the reservoir. It will also be noted from FIG. 1 that solubility of the mixed gas at a constant pressure decreases with decreasing carbon dioxide content. In considering the data depicted in FIG. 1, it should be borne in mind that an increase in the amount of $CO_2$ dissolved in the oil ($R_{so}$) results in a corresponding increase in $B_o$. This is proportional to the increase of oil saturation, which in turn is proportional to the displacement of oil into the production well, i.e., the % oil recovery. According to FIG. 1 it has been found that in the case of an injected natural gas having 81 vol. % $CO_2$ content, up to about 30 atmospheres, there is no significant difference in the values of $R_{so}$ and $B_o$ in the case of pure $CO_2$ (point 1) and pure hydrocarbon gas (point 2, principally methane). The curves diverge between 30 and 60 atmospheres, at points 3 and 4, respectively; while above 60 atmospheres, the percentage of $CO_2$ is quite important. Notice that the 50% $CO_2$ line is almost straight, that is, the rate of change of $R_{so}$ and $B_o$ with changing pressure is constant. Above 50% the curves are upwardly concave and below 50% they are downwardly concave. Unless otherwise indicated, % values of gases refer to % by volume.

The 50% $CO_2$ line indicates that the ratio of $CO_2$ and CH gases in the reservoir is 1:1. This is a critical line as under this line $B_o$ and $R_s$ increase at a smaller rate with increasing pressure and thus the efficiency of $CO_2$ gas cannot be improved as described. The curves show that at, say, 80 atmospheres, with pure $CO_2$ gas 137 $m^3$ dissolves at 68° C. (point 5); while in pure hydrocarbon gas 60.5 $m^3$ dissolves (point 6); and 88 $m^3$ with 65% $CO_2$ (point 7). Thus, to reach a dissolution rate corresponding to pure $CO_2$, in the case of a gas containing 65% $CO_2$, instead of at 80 atmospheres, a reservoir pressure of 120 atmospheres would be used (point 8); while at 50% $CO_2$, 150 atmospheres are required (point 9).

It will be apparent that if the reservoir does not have a gas cap, and is depleted, its hydrocarbon gas content, both free and in solution, will be at a minimum. But should the reservoir possess a gas cap, and its content of dissolved gas also be significant, then the injected gas should have a higher carbon dioxide content.

Thus, e.g. if the total amount of CH-gases in the oil-reservoir is 100 million cubic m ($Mm^3$), the same amount of pure $CO_2$ gas has to be injected to achieve at least the 1:1 ratio of $CO_2$:CH in the reservoir.

If a gas containing only 65% by volume of $CO_2$ can be injected, 350 $Mm^3$ of such gas has to be injected. In this case the reservoir contains 225 $Mm^3$ CH gas and 225 $Mm^3$ $CO_2$, which means 50% $CO_2$ in the reservoir.

If by the amount of 350 $Mm^3$ of gas the original reservoir pressure is attained, so also 350 $Mm^3$ of pure $CO_2$ has to be injected to achieve the original formation pressure. In this case, however, the reservoir contains 100 $Mm^3$ of CH gas and 350 $Mm^3$ of $CO_2$, i.e. the $CO_2$ content of the gas in the reservoir will be 77.8%, giving a favorable result, as can be seen in FIG. 1. If the original pressure is achieved by the injection of 100 $Mm^3$ of gas, so in the case of a gas containing 65% $CO_2$, the formation pressure should be increased to the value obtained by injecting 350 $Mm^3$ of gas. That means that if the parameters of a given oil reservoir on the ordinate of FIG. 1 are known, the formation pressure ensuring the achievement of at least 1:1 ratio of $CO_2$:CH gases can be read from the abscissa of FIG. 1. It also follows that the reservoir pressure should always be increased by the gas to be injected, except, when it is not possible due to unlimited water supply. The pressure is increased by water according to processes known per se. Increasing pressure by water, however, changes the saturation relations, and increases the water saturation of the reservoir, which is a disadvantage. According to the present invention the pressure is increased by the injected gas, whereby the water saturation is not increased and simultaneously the favorable effects of the $CO_2$ on the reservoir, the reservoir liquids and the dissolution of $CaCO_3$ are seen in the course of the gas injection.

Figure 2:
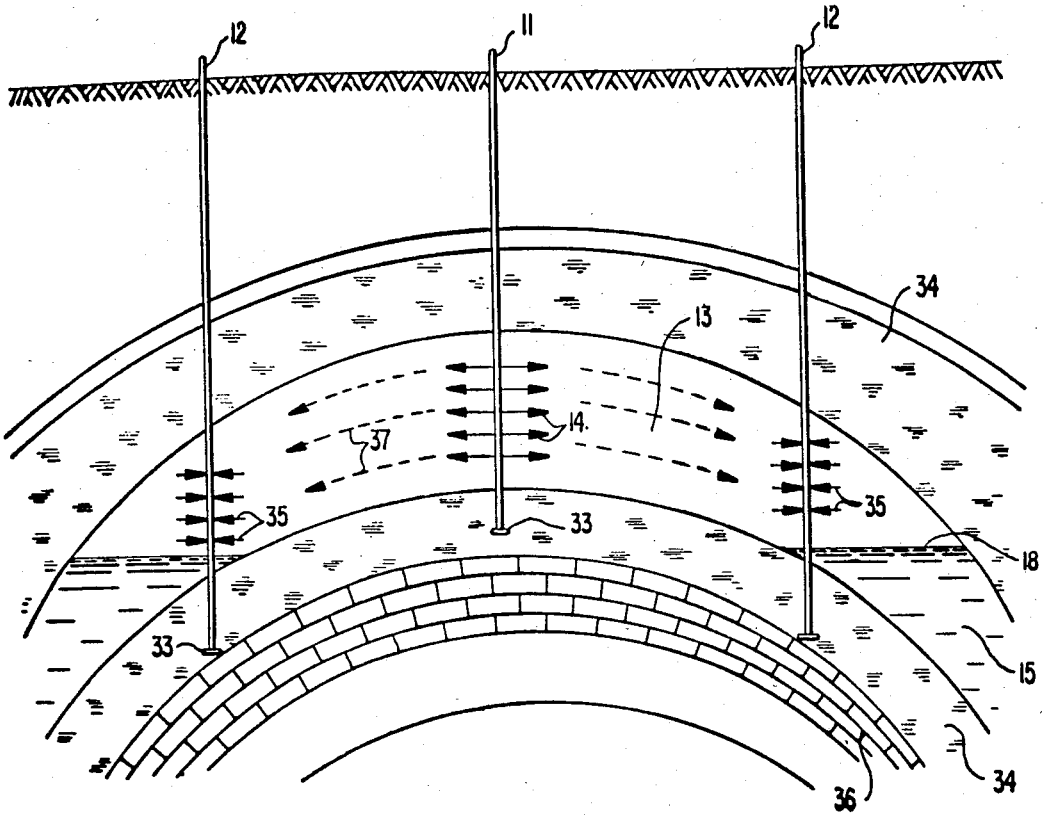
FIG. 2 shows a schematic cross-sectional view of a crude oil reservoir of quartz sandstone, having no gas cap.

FIG. 2 shows schematically a geological cross section of a formation having shale beds 34 surrounding the oil bed 13. The water is shown at 15 and the oil zone at 13, the water-oil interface being at 18. Injection wells 11 and production wells 12 are provided, the bottom ends 33 of which are located in a shale bed 34. Carbon dioxide gas emerging from the perforations 14 in the side walls of well 11 passes into oil body 13. Crude oil flows through perforations 35 into production wells 12 and thence to the surface.

Figure 2A:
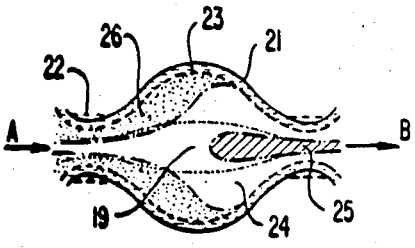
FIG. 2*a* shows a greatly enlarged and idealized cross-section of a pole of an oil producing formation.

The oil bed or formation 13 is in effect a reservoir possessing an intergranular porosity. The pore space, a sectional view of which pores is shown in FIG. 2*a*, has an actual size of about $10^{-2}$ to $10^{-4}$ mm. The pore is limited at 21 by the interface of rock grain and/or cementing material. The connate water film is shown at 23, the effective pore volume being within this film and at the beginning of production it is filled only with oil. In the course of primary production, part of the oil will be driven out of the pore. During secondary production, when the oil is further displaced by gas, the effective pore volume is filled by the residual oil 24 and by the moving gas phase 19.

Figure 2B:
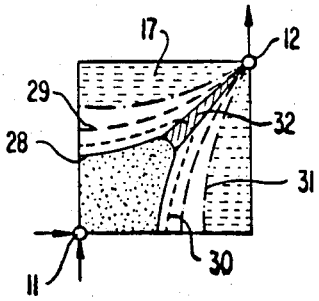
FIG. 2*b* shows in cross-section the region between an injection well and a producing well.

In FIG. 2*b* there is shown a top view of the formation between an injection well 11 and a producing well 12, the wells 11 and 12 being located in a conventional grid pattern. Phantom line 29 shows the area in which the gas 19 has displaced the oil 24 from the pores.

As indicated above, the carbon dioxide containing gas passes along the paths indicated generally by the arrows 37 in FIG. 2 towards the perforations 35.

In FIG. 2*b* is shown the situation in which the injected gas, whose boundary is indicated generally at 28, may break through into the production well 12, through the shaded area 32. Shutting down the production well, however, causes the shaded area 32 to become saturated with oil and so the breakthrough is cured.

While the production wells are shut down the gas injection continues until the formation pressure—as indicated in FIG. 1—is reached.

After the necessary reservoir pressure has been reached, water is injected through well 11, which follows the previous flow paths of the gas to the surface through production wells 12. The pores adjacent to the injection well 11, in addition to the connate water 23, will be filled with residual oil containing heavy components and by the injected gas containing carbon dioxide. At the onset of water injection, the injected water dissolves the carbon dioxide gas in these pores and becomes saturated with carbon dioxide. As this water saturated with carbon dioxide moves in the direction of the arrows 37, the part of the gas which cannot be dissolved by the injected water will be partly displaced by the water and partly will remain behind as residual gas which will then later be dissolved into further injected water. The water thus saturated by carbon dioxide is shown in FIG. 2*a* at 25 and will displace the oil 24 which has also become saturated with carbon dioxide in the same way. In FIG. 2*b*, that area which can be water flooded is bounded by the limits 31.

Referring again to FIG. 2*a*, it will be noted that the calcium carbonate cementing material dissolved by the carbon dioxide is indicated at 22 and is located at the narrowest portion of the pore throat where the carbon dioxide velocity is the highest. Although the dissolution of the calcium carbonate material of the rock is relatively small, the enlargement of the pore throat is, nevertheless, significant; and the resulting increase in permeability has a very significant and favorable effect on secondary recovery.

FIG. 3 shows an oil zone and a gas cap at 16, with the gas-oil interface at 20. The perforations 14 of the injection well 11 open both in the gas and in the oil zones. The perforations 35 in the producing wells 12 are only in the oil zone 13.

$CO_2$-containing gas is injected into the gas cap in order to increase the reservoir pressure and in order to reach the desired $CO_2$:CH ratio in the gas cap containing CH which otherwise decreases efficiency.

Water injection, like gas injection, is thereafter conducted in both zones 13 and 16. The displacement of the oil and water saturated with carbon dioxide will take place in the same way as with FIG. 2. However, in addition to the function of FIG. 2, FIG. 3 has the characteristic that the water injected into gas cap 16 can dissolve only a part of the carbon dioxide existing as a free gas phase, the rest of the carbon dioxide in zone 16 being compressed and forced into zone 13, which further favorably affects the recovery in the oil zone.

FIG. 4 shows an oil zone 40 in a limestone reservoir. The pore space has a compound porosity comprised not only by the pores of the matrix, but also by a system of fractures. Gas is injected as before, through the injection wells 11 and thence to the production wells 12 and 38, whose perforations 35 are located above the original contact 18 between the oil and the water zones 36 in the oil zone 40.

Figure 5:
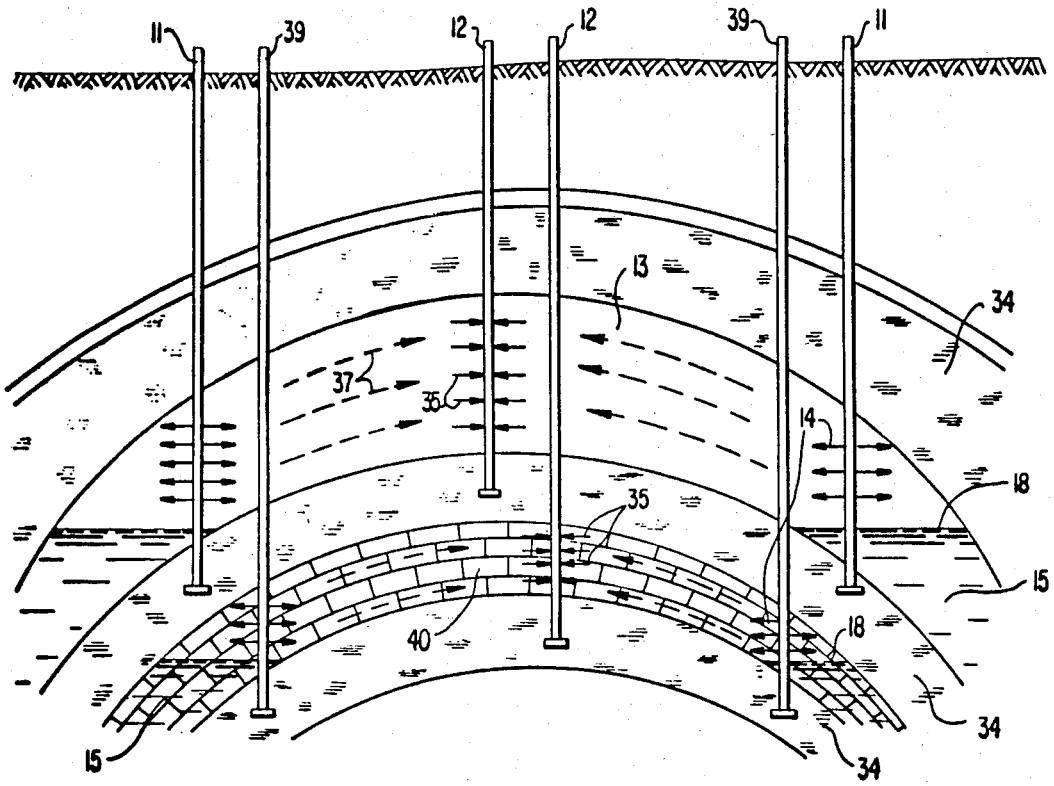
FIG. 5 shows a sandstone and limestone reservoir in an initial stage having an unlimited water supply at a certain production rate.

FIG. 5 shows a formation having sandstone reservoirs 13 and limestone reservoirs 40 with unlimited water supply. Upon production, water from the water zones 15 moves into the zones 13 and 40. In zone 15 residual oil is to be found after the water displacement which can be decreased with $CO_2$ injected through perforations 14 of the injection wells 39. The perforations 14 of the injection wells 11 and 39 are above the original water-oil contact 18. Upon injecting gas through the perforations 14, while no water is injected, the water-oil contact region remains stationary; but after gas injection is completed, then the saturated oil will be displaced by the pressure of the encroaching water from zones 15, thereby to force the oil through the perforations 35 of the production wells 12 to the surface. The water encroachment, however, is limited by the remaining injected gas. The water encroaching from zones 15 due to unlimited water supply replaces the water injection after the gas injection and so there is no need for subsequent water injection.

Figure 6:
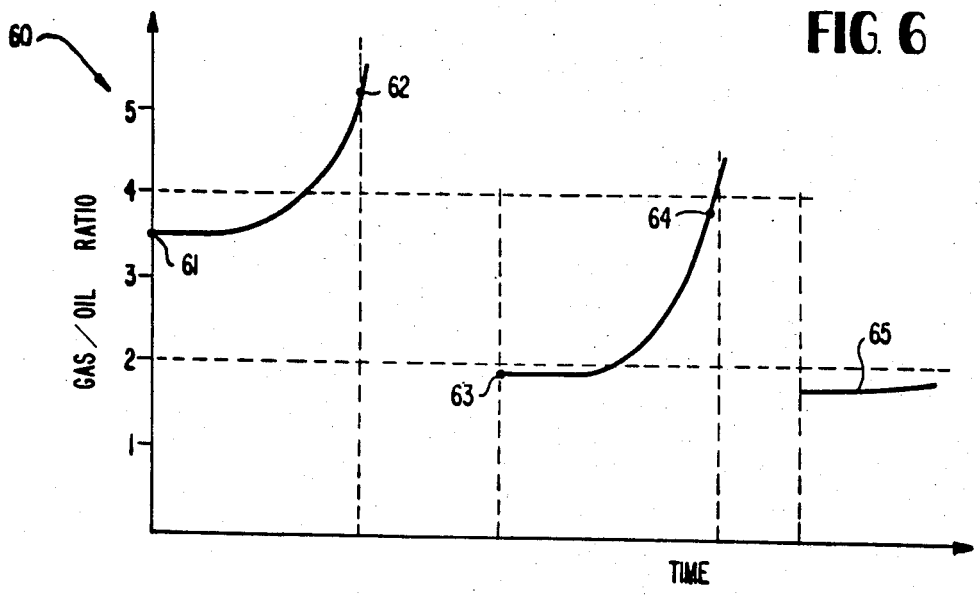
FIG. 6 shows graphically the control of the operation of the producing well as a function of the gas-oil ratio.

FIG. 6 is a graph of gas-oil ratios on the ordinate versus time of exploitation on the abscissa. FIG. 6 can also be related to FIG. 1. Thus, for a pressure value of 100 atm. and a carbon dioxide content of 50%, as shown on FIG. 1, $R_{so}=94\ m^3/m^3$. This is shown as point 61 in FIG. 6 which designates the gas-oil ratio of $3.9\times94$ or 329 $m^3$ of gas per $m^3$ of oil. If the carbon dioxide content is 65%, then at 100 atm. $R_{so}=112\ m^3/m^3$; which when multiplied by the gas-oil ratio at point 61 provides a gas-oil ratio of 382 $m^3/m^3$.

At the onset of injection of the carbon dioxide gas, the production wells can have gas-oil ratios of widely differing value, that is, between 200 and 3,000. If in the course of carbon dioxide injection this initial value increases by, say, 30% for example, from 3,000 to 3,900 $m^3/m^3$, and the $CO_2$ content in the gas produced reaches 30–50%, the well must be shut-down. These conditions are indicated at 62 in FIG. 6.

After shut-down, with further passage of time, the conditions are represented by point 63 in FIG. 6; but again, the gas-oil ratio can increase until point 64 is reached, at which point the well must again be shut-down.

With further regard to FIG. 6, continuous production is most advantageous at gas-oil ratios corresponding to 65 in FIG. 6. However, production is also effective and economical between points 63 and 64 in FIG. 6.

In the course of oil production in oil reservoirs another important parameter apart from the gas-oil ratio is the water content of the produced fluid. Different types of reservoirs can be in a different state of wetting when starting gas injection. The water quotient of the produced fluid may be in the range from 0 to 100%. In the case of wet reservoirs the production wells have to be operated after having started the $CO_2$injection even if it contains 100% of water at the beginning. Upon injecting $CO_2$ the water content of the produced fluid decreases as an oil zone is formed.

Figure 7:
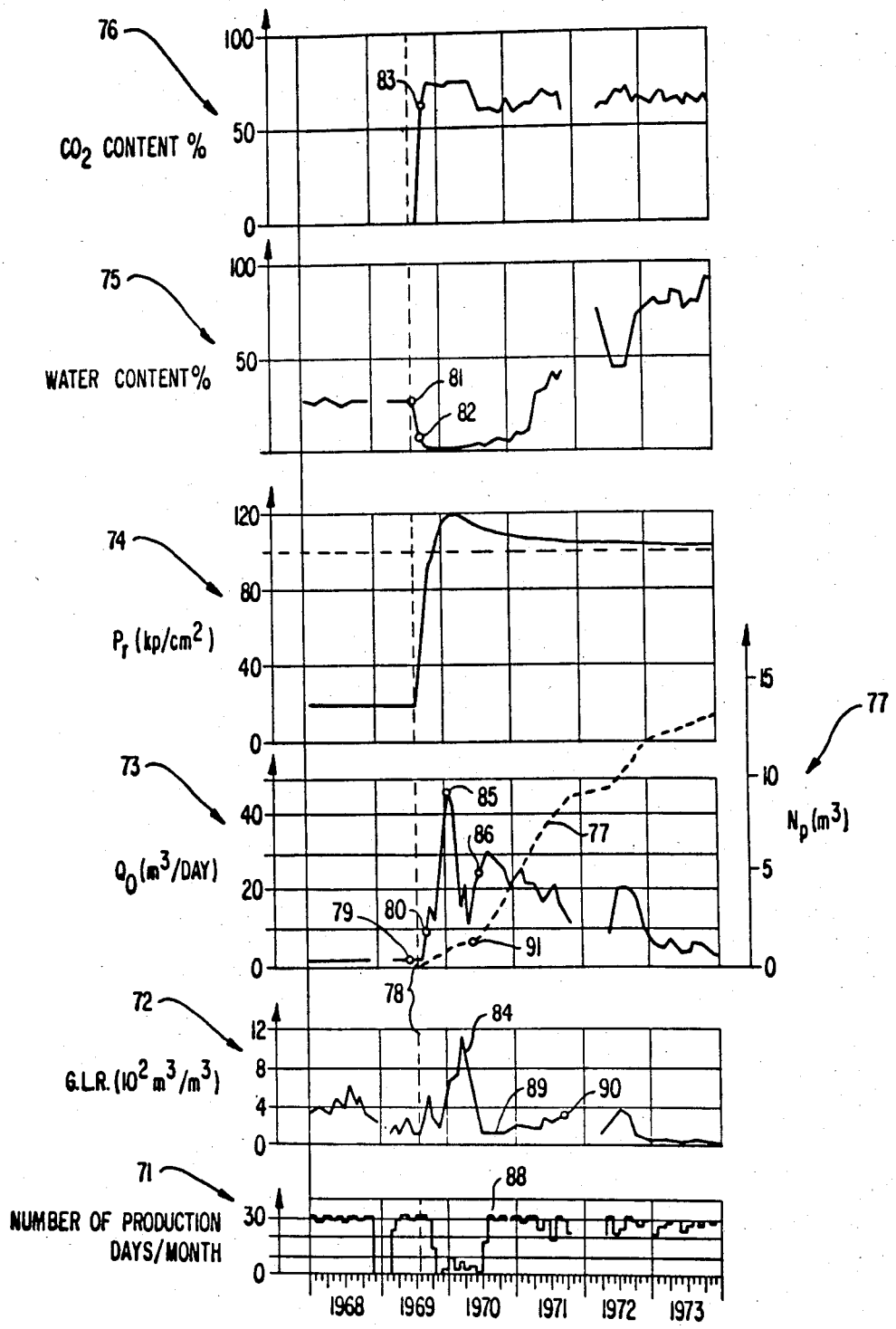
FIG. 7 shows the production history of a well described hereinafter as an example.

In correlation with FIGS. 2*b* and 6 the water content may increase when the well is shown-down in order to stop gas breakthrough and it may decrease when opened again, as shown by the water % curve 75 in FIG. 7. After the $CO_2$-containing gas injection, in the course of water injection the injected water breaks through after a while into the production wells, whereafter the water content is gradually increased, though the pore cross-section is increased by $CO_2$ and therefore this period is characterized by a certain fluctuation. $CO_2$ enters the smaller pores (later by molecular diffusion) and the oil is displaced from the pores by $CO_2$ dissolving the calcium carbonate binding material in an increased cross-section when water is flowing in the larger pores. Thus the further oil gets into the water flow, the water becomes oily and the water content of the production well becomes unstable. That is why it is important to operate the production wells after the breakthrough of the injected water (following the injection of $CO_2$ containing gas) to achieve at least a 40:1 water-oil ratio.

Several experiments were carried out to investigate the process and efficiency of oil displacement with $CO_2$ using gas mixtures of different $CO_2$ content corresponding to different reservoir types and relations. All the experiments investigating the effect of the rate of displacement showed that the recovery was increased by increasing the rate of displacement.

The following laboratory results were obtained at 68° C. and 100 atm. using a gas of 81% $CO_2$ content under the conditions of a reservoir given below in the Example:

| V(m/day) | (%) | $S_{or}$ |
|---|---|---|
| 0.50 | 58.0 | 29.02 |
| 2.92 | 62.2 | 26.11 |
| 12.91 | 66.1 | 23.43 |
| 64.56 | 70.3 | 20.5 |

where:
V = rate of displacement, m/day
(%) = efficiency of displacement, %
$S_{or}$ = residual oil saturation at surface volume, %.

The above data show that the residual oil saturation decreases with increasing flow rate.

When injecting the carbon dioxide-containing gas at a high velocity into the injection wells 12, as shown in FIGS. 2 to 5, the gas flows through perforations 14 with high velocity in the course of which it not only displaces the oil but also vaporizes residual oil of the pores as well, carrying the vaporized oil along with it. More closely adjacent to the production wells 12 even more oil vaporizes into the gas and thus becomes saturated. As the radius from the well 11 increases, the velocity decreases and at a certain point oil will no longer be vaporized by the saturated gas. Moreover, moving away from the injection well, as the carbon dioxide progressively dissolves in the oil of the pores, the oil components again segregate out of vapor phase.

The oil saturation of the pores increases not only due to the swelling resulting from dissolution of carbon dioxide, but also by what might be called condensation of the previously vaporized oil. Thus, in a direction from well 11 to wells 12, the saturated gas is progressively replaced by oil saturated with carbon dioxide, as indicated schematically at 25 in FIG. 2*a*. The carbon dioxide, of course, saturates the primary residual oil of the pore as well.

The conventional gas injection is carried out at a distance of 10 to 15 m from the injection well at a maximal flow rate of 0.5 m/day, due to which the undissolved gas flows away in the front without forming a fluid-oil plug. The low flow velocity behind the front does not carry along oil, which would form an oil plug after condensing the front. The fluid collected in the front forms a plug, the displacement of which causes an increase of the pressure in the front and behind it. At a high rate of injection the pressure in the front and behind it increases and the moving of the fluid-oil plug is carried out at a higher pressure. This can be seen in FIG. 7, the pressure increased in the production well during the breakthrough from 30 atm. to 100 atm. within 1–2 days. This phenomenon of the high rate of injection is of great importance in increasing efficiency. The injected gas flows in a space of high pressure and is thus efficient and promotes the formation of the front.

We have found that if the injection velocity is high only at a distance of 10 to 15 meters from the injection well, the gas does not vaporize as much oil as could form an oil plug condensing at the front. The injection at high velocity has to ensure a flow velocity of 3–12 $m^3$/day even in a radius of 75–100 m corresponding to the laboratory data mentioned above.

The high rate of injection has to ensure that the progressing velocity of the front decreases the residual oil saturation formed by the conventional low rate injection up to a radius of 75–100 m. That is, instead of the 0.5 m/day velocity corresponding to the low rate of injection, the progressing velocity of the front should be 3–12 $m^3$/day up to a radius of 75–100 m. Thus from a distance of 75–100 m from the injection well sufficient oil leaves in order to form a front. As the flow velocity can be provided by the injection rate, the velocities mentioned above can be provided by the rate of injection. Thus the injection rate values are those critical values which are indispensable to ensure the aforementioned effects i.e. the 500–1,000 $m^3$/day/m flow formation thickness.

The flow formation thickness is a part of the total formation thickness available for the flow:

$$h_f = h_t \cdot \phi \cdot S_g$$

where
$h_f$=flow formation thickness, m
$h_t$=total formation thickness, m
$\phi$=porosity
$S_g$=gas saturation
The more usual formation thickness value amounts to 40–80 $m^3$/day/well/m.

To enable those skilled in the art to practice the invention the following non-limiting example is given:

EXAMPLE

In the deep portion of the Budafa field, a mixed gas reservoir containing by volume 82% $CO_2$, 0.4% $H_2S$, 14% methane and 3% nitrogen and heavier hydrocarbons was discovered at a depth of 3,000 m in 1968. The reservoir having produced since 1937 had been subjected to primary production and lay at a depth of 1,000 to 1,100 meters and is limited by a bounding fault and by wedging and is in contact with a water saturated formation but there had been no water encroachment during primary production. The formation consists of quartz sandstone containing 26% by weight calcium carbonate as cementing material, and has a porosity of 21.5%, a permeability of 25–30 mD, and an average thickness of 8 meters. The reservoir oil is a bright light oil, which at the original pressure was saturated with gas. During primary production there had been performed an injection of hydrocarbon gas, and afterwards a water injection. The injection of the hydrocarbon gas increased the cumulative recovery factor by 8.8% and the water injection by 3.8%.

After these steps the onset of injection of carbon dioxide-containing gas can be seen in FIG. 7 indicated by the dotted line 78 above 1969 July.

To the left of the dotted line 78 the change of the parameters before the injection of the carbon dioxide-containing gas, and to the right the change of parameters under the gas injection and the subsequent water injection can be seen. Thus, e.g. curve 74 in FIG. 7 shows that before the $CO_2$-containing gas had been injected the reservoir pressure was 23 atm. and when the gas injection was finished—February 1970—the pressure was 120 atm. In FIG. 1, on the 0% $CO_2$ curve $B_{oCH}$=1.115 and $R_{sCH}$=25 $m^3/m^3$ corresponds to 23 atm. formation pressure.

At the attained 100–120 atm. bottom hole pressure, the carbon dioxide component increased to 65% so that the gas dissolved in 1 $m^3$ of reservoir oil was 112–138 $m^3$, of which 68.8 to 89.7 $m^3$ was carbon dioxide. The value of $B_o$ was 1.325–1.395, in contrast to the initial value of 1.115.

Formation pressure curve 74 of FIG. 7 shows that the formation volume of the injected gas has to be calculated at least at 100 atm.

The injection rate calculated on flow formation thickness:

$h_f = 12$ m $\phi = 0.215$ $S_g = 0.30$ $h_f = h_f \cdot \phi \cdot S_g = 12 \times 0.215 \times 0.30 = 0.774$ m, i.e. 0.774 m of the 12 m thick formation is available for the gas flow rate.

Converting the injected amount to 1 m flow formation thickness:

$Q = q/h_f = 800/0.774 = 1030$. The value when rounded off gives 1,000 $m^3$/day/well/m flow formation thickness. Coming back to the laboratory displacement experiments it follows that the 40–80 $m^3$/day/well/m formation thickness injection rate is by an order of magnitude higher injection rate than the conventional injection rate.

The quantity of the injected gas was 35–40 times the quantity of oil, gas and water which had been produced during gas injection, calculated on the reservoir volume. The reservoir pressure ($P_r$) increased as on curve 74. As is shown by curve 72, the gas-liquid ratio (G.L.R.) increased; the curve of oil production shows that from 1.4 $m^3$ per day (point 79) existing before injection, there was an increase to 10 $m^3$ per day (point 80). Thereafter, the water content of the produced fluid, as shown by curve 75, decreased from 30% (point 81) to 10% (point 82) and then to 1 to 2%. The carbon dioxide content of the produced gas reached 65% by volume (point 83), as shown by curve 76.

On graph 71, it will be seen that between October 1969 and June 1970 there were only a few producing days per month. Thus the gas-fluid ratio is high, as at point 84 on graph 72. The high values of oil production (point 85) during this period are characteristic not of continuous operation but only of short test productions. Continuous production began in July 1970 (point 86). Because of the low water cut, the gas-fluid ratio was almost equal to the gas-oil ratio. At this time, the value of the gas-fluid ratio on FIG. 1 (point 87) was 128 $m^3/m^3$.

FIG. 7 also shows that during the period of continuous production (point 88) the gas-fluid ratio corresponding to the gas-oil ratio at point 89 had desirable values for a number of months. Later, when the gas-fluid ratio at point 90 surpassed the four-fold value of the solution gas, at a pressure of 108 atm. at 121 $m^3/m^3$, corresponding to the given pressure, the well 12 was again shut down.

On curve 77 of the cumulative oil production ($Q_o$) (right hand ordinate of graph 73) it will also be noted that during the period of shutting-down because of high gas-fluid ratio, in the course of the test production, more oil had been produced (1,340 $m^3$) than if the well had been producing throughout with the rate existing before gas injection (270 days, 380 $m^3$).

The quality of the oil thus produced, throughout the entire production, during periods of both high and low gas-fluid ratio, and the specific gravity of the oil and its content of light ends remained substantially unchanged. Thus it was apparent that the carbon dioxide displaces from the formation not only the light components of the oil but also the heavy ones. It is apparent, therefore, that not only the viscosity but also the interfacial tension of the oil is reduced thereby facilitating its displacement.

The well illustrated by the above Example produced for the period of 4½ years up to the end of 1973, more than three times its production during the previous eight years. The recovery factor of the reservoir increased by 12%.

COMPARATIVE EXAMPLE

A comparison was made of the effect of dilution of $CO_2$ with hydrocarbon gases and nitrogen on the production rate in secondary recovery of oil at varying reservoir pressures. Mixtures of nitrogen and hydrocarbon gases were also studied.

| | PRODUCTION RATE (%)/PRESSURE (ATM) | | | | | | | | |
|---|---|---|---|---|---|---|---|---|---|
| | 100 | 120 | 150 | 200 | 250 | 300 | 350 | 400 | 500 |
| | | | | $CO_2$/CH | | | | | |
| % $CO_2$ | | | | | | | | | |
| 65 | 72 | 84 | 93 | 97 | 98 | | | | |
| 70 | 80 | 89 | 95 | 98 | 98 | | | | |
| 75 | 86 | 92 | 96 | 98 | 98 | | | | |
| 80 | 92 | 94 | 97 | 98 | 98 | | | | |
| 85 | 94 | 95 | 98 | 98 | 98 | | | | |
| 100 | 95 | 96 | 98 | 98 | 98 | | | | |
| | | | | $CO_2/N_2$ | | | | | |
| % $CO_2$ | | | | | | | | | |
| 65 | 76 | 78 | 79 | 81 | 90 | 97 | 98 | | |
| 70 | 80 | 81 | 83 | 84 | 94 | 98 | 98 | | |
| 75 | 83 | 84 | 86 | 88 | 97 | 98 | 98 | | |
| 80 | 85 | 87 | 88 | 92 | 98 | 98 | 98 | | |
| 85 | 88 | 90 | 91 | 95 | 98 | 98 | 98 | | |
| 100 | 95 | 96 | 98 | 98 | 98 | 98 | 98 | | |
| | | | | $N_2$/CH | | | | | |
| % $N_2$ | | | | | | | | | |
| 65 | 42 | 43 | 44 | 46 | 51 | 57 | 68 | 94 | 98 |
| 70 | 47 | 48 | 49 | 51 | 56 | 62 | 76 | 96 | 98 |
| 75 | 51 | 52 | 53 | 56 | 59 | 68 | 84 | 97 | 98 |
| 80 | 55 | 56 | 57 | 59 | 64 | 74 | 89 | 98 | 98 |
| 85 | 57 | 58 | 59 | 61 | 67 | 82 | 95 | 98 | 98 |
| 100 | 59 | 60 | 61 | 64 | 81 | 94 | 98 | 98 | 98 |

Figure 8:
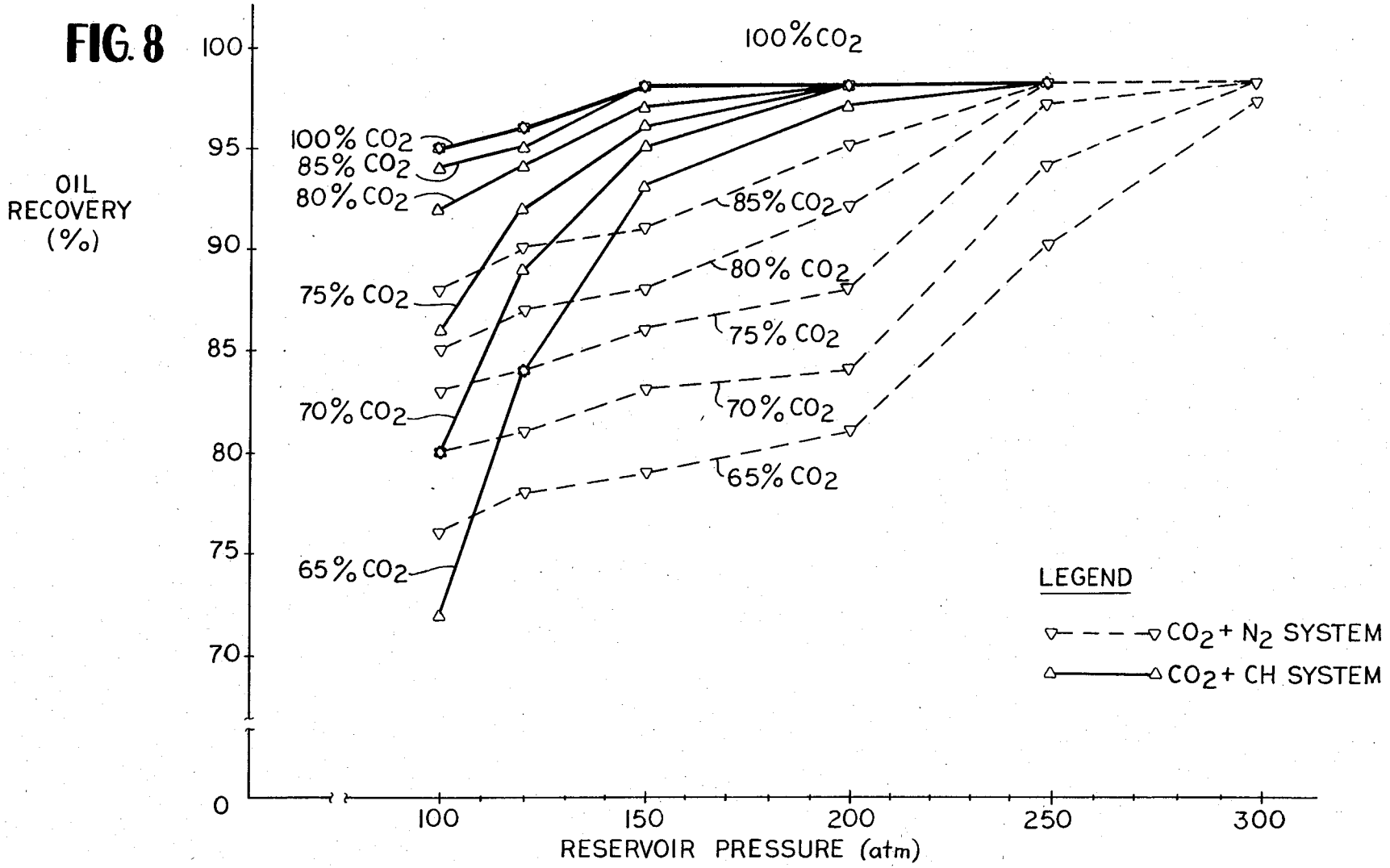
FIG. 8 shows a comparison of the oil recovery obtained at various pressures using $CO_2$ gas mixed with $N_2$ and with CH gases.

The above data for the $CO_2$/CH and $CO_2/N_2$ mixtures are plotted in the graph form in FIG. 8.

As can be seen from the above table, mixtures of nitrogen and hydrocarbon gases were not effective except at very high pressures. Likewise, mixtures of $CO_2/N_2$ required higher pressures and a higher percentage of $CO_2$ to give as high yields as $CO_2$/CH mixtures. It can be seen from FIG. 8 that the greatest dilution by CH, i.e. 65% $CO_2$ provides unexpectedly greater oil recovery ranges from above 107 atm. up to 250 atm., over the corresponding $CO_2/N_2$ mixtures. By comparison, however a natural gas mixture containing $CO_2$ which is readily available in oil fields, frequently ambient or in situ can be used advantageously in the present invention.

Although the present invention has been described and illustrated in connection with preferred embodiments, it is to be understood that modifications and variations may be resorted to without departing from the spirit of the invention. Such modifications and variations are considered to be with the purview and scope of the present invention as defined by the appended claims.

We claim:

1. In a process for the secondary recovery of crude oil from subterranean reservoirs by injecting carbon dioxide-containing gas into the reservoir through at least one injection well penetrating into the reservoir until a desired volume of carbon dioxide has been added, injecting water through at least one injection well to force such carbon dioxide through the reservoir, and withdrawing oil through at least one production well at such a flow rate as to maintain a reservoir pressure of at least 100 atm. until the water breaks through into the production well, the improvement comprising diluting the carbon dioxide gas in the reservoir with from 5 to 35 vol. % of hydrocarbon gases at a reservoir pressure ranging from above 107 up to 250 atm.

2. The process of claim 1, wherein the carbon dioxide is diluted with from 10 to 30 vol. % of hydrocarbon gases.

3. The process of claim 1, wherein the reservoir pressure is maintained at 120 to 200 atm.

4. The process of claim 1, wherein the gas is injected at a rate of 40–80 cubic meters per day per meter of formation under reservoir conditions corresponding to 500–1,000 cubic meters/well/day/m calculated on flow cross-section.

5. The process of claim 4, wherein the water injection is continued until a water:oil ratio of at least 40:1 occurs in the production well into which the water has broken through.

6. The process of claim 1, wherein the reservoir comprises an oil zone and a gas cap above the oil zone and the gas is injected into both the oil zone and the gas cap.

7. The process of claim 1, wherein the reservoir comprises an oil zone above a water zone from which water encroaches on the oil zone and the gas is injected into both the oil zone per se and the area of the oil zone already swept by encroaching water from the water zone.

* * * * *